US008650922B2

(12) United States Patent
Hayashi

(10) Patent No.: US 8,650,922 B2
(45) Date of Patent: Feb. 18, 2014

(54) PIPE BENDER AND METHOD FOR SPIRAL PIPE BENDING WITH THE PIPE BENDER

(75) Inventor: Hideo Hayashi, Ome (JP)

(73) Assignee: Busyu Kogyo Co., Ltd., Ome-shi, Tokyo (JP)

( * ) Notice: Subject to any disclaimer, the term of this patent is extended or adjusted under 35 U.S.C. 154(b) by 0 days.

(21) Appl. No.: 13/702,029

(22) PCT Filed: Jun. 1, 2011

(86) PCT No.: PCT/JP2011/062562

§ 371 (c)(1),
(2), (4) Date: Dec. 4, 2012

(87) PCT Pub. No.: WO2011/152440

PCT Pub. Date: Dec. 8, 2011

(65) Prior Publication Data

US 2013/0086962 A1 Apr. 11, 2013

(30) Foreign Application Priority Data

Jun. 4, 2010 (JP) ..... 2010-128522

(51) Int. Cl.

| | |
|---|---|
| ***B21D 7/04*** | (2006.01) |
| ***B21D 7/02*** | (2006.01) |
| ***B21D 9/05*** | (2006.01) |
| ***B21D 31/00*** | (2006.01) |

(52) U.S. Cl.
USPC ..... 72/149; 72/215; 72/387

(58) Field of Classification Search
USPC ..... 72/68, 149, 214–219, 307, 387
See application file for complete search history.

(56) References Cited

FOREIGN PATENT DOCUMENTS

| | | |
|---|---|---|
| JP | 60-231527 | 11/1985 |
| JP | 03-071928 | 3/1991 |
| JP | 3-71928 | 3/1991 |
| JP | 2003-53432 | 2/2003 |

OTHER PUBLICATIONS

International Search Report for International Application No. PCT/JP2011/062562 mailed Aug. 23, 2011.
Japanese Office Action for JP2010-128522 mailed Sep. 12, 2012.

*Primary Examiner* — Teresa M Ekiert
(74) *Attorney, Agent, or Firm* — Merchant & Gould P.C.

(57) ABSTRACT

Provided are a pipe bender which is capable of spiral pipe bending and a method for spiral pipe bending with radii of bend using the pipe bender. The pipe bender includes an XY sliding mechanism), which has a Y-axis movement means travelling back and forth and an X-axis movement means travelling from side to side; a turning table device for rotating a turning table provided on top thereof, the turning table device being placed on the XY sliding mechanism; a bender with a cylindrical shaft rotatably supported, the cylindrical shaft placed on the turning table and secured to a worm wheel; a center shaft passing through the hole of the cylindrical shaft and having a lower end secured to a bottom; and a bending roller provided on top of the cylindrical shaft rotatable about the center of a support roller and which is disposed adjacent to the support roller.

2 Claims, 8 Drawing Sheets

(a)

(b)

$(D_1 < D_2 < D_3 \cdots < Dn)$

PIPE BENDER AND METHOD FOR SPIRAL PIPE BENDING WITH THE PIPE BENDER

This application is a National Stage Application of PCT/JP2011/062562, filed 1 Jun. 2011, which claims benefit of Serial No. 2010-128522, filed 4 Jun. 2010 in Japan and which applications are incorporated herein by reference. To the extent appropriate, a claim of priority is made to each of the above disclosed applications.

TECHNICAL FIELD

The present invention relates to a pipe bending machine and a bending method for producing a spiral pipe by using the pipe bending machine.

BACKGROUND ART

In recent years, use of combustionless, heat-pump type water heaters (e.g., EcoCute (registered trademark)) has been widely spread in industry and ordinary household as measures for reduction of $CO_2$, which is assumed to be a ringleader of the global warming. In addition, fuel cells (e.g., ENE FARM (registered trademark)) by Tokyo Gas Co., Ltd.), which are new energy systems extracting hydrogen from gas and generating electricity. In the above new water heaters, heat exchange from cold water to warm water is necessary, and the heat exchanger using the meandering type copper pipe illustrated in FIG. 8(*a*) is generally known.

As illustrated in FIG. 10, the conventional pipe bending machine 90 includes a support roller 92, a bending roller 93, and a chuck 94. A groove having the shape of a semicircle is formed on the outer circumferential surface of the support roller 92 in such a manner that a pipe can be inserted through the groove. Another groove having the shape of a semicircle is formed on the outer circumferential surface of the bending roller 93, and the bending roller 93 is supported in such a manner that the bending roller 93 can be turned around a center of rotation, which is the center O of the support roller 92. The chuck 94 holds the pipe. When a pipe is inserted through the gap formed between the two grooves in the support roller 92 and the bending roller 93, and the bending roller 93 is turned around the center O of the support roller 92, the pipe can be bent so as to have a bend diameter identical to the diameter of the support roller 92. (See, for example, Patent Literature 1.)

As illustrated in FIG. 8(*a*), the characteristic of the conventional meandering type heat exchanger pipe is that the bend diameter of the pipe is uniformized to a single value ϕD. Since the conventional pipe bending machine 90 can perform only one type of pipe bending realizing the single bend diameter of ϕD, the meandering type pipes have been used as heat exchanger pipes until now.

However, the meandering type heat exchanger pipes as above need installation space with some extent, and it is impossible to avoid increase in the installation space in order to secure certain heat exchanger effectiveness. In addition, the future direction of the products such as water heaters is weight reduction and downsizing. Therefore, the use of the meandering type heat exchanger pipes goes against the future direction.

FIG. 8 (*b*) is a front view illustrating a shape of a spiral type heat exchanger pipe. The space needed for accommodation of the spiral type heat exchanger pipe having a length is approximately one-third of the installation space needed for accommodation of the meandering type heat exchanger pipe having the same length. In other words, the heat exchanging capacity which the spiral type heat exchanger pipe can achieve in a space is three times the heat exchanging capacity which the meandering type heat exchanger pipe can achieve in the same space, and therefore the spiral type heat exchanger pipe is suitable for the downsizing in EcoCute in the future.

Nevertheless, in the case where a spiral pipe is produced by bending a pipe in a conventional pipe bending machine as illustrated in FIG. 8 (*b*), the bend diameter is increased after every bend as D1<D2<D3 . . . <Dn. Therefore, the support roller 92 is required to be replaced after every bend is made in the pipe, so that the pipe bending operations cannot be successively performed.

CITATION LIST

Patent Literature

Patent Literature 1: Japanese Patent Laid-Open No. 2003-53432 (FIG. 1)

SUMMARY OF THE INVENTION

Technical Problem

The present invention is made in view of the above problems. An object according to the present invention is to provide a pipe bending machine which can cope with increase in the bend diameter and can successively perform bending operations for producing a spiral pipe in which the bend diameter is increased after every bending operation, and another object according to the present invention is to provide a pipe bending method using the above pipe bending machine.

Solution to Problem

The pipe bending machine (100) described in claim 1 is a pipe bending machine which feeds a pipe (W) to the gap between a support roller (42) and a bending roller (43), and successively performs bending operations with bend diameters (D2, D3, . . . , Dn) greater than the diameter (D1) of the support roller (42) while changing the position of the center (O) of the support roller (42) in synchronization with the turning angle of the bending roller (43). The pipe bending machine (100) described in claim 1 is characterized in including: an XY slide mechanism (G) being placed on a frame (1) and including, a Y-axis movement means (E) which moves in the Y-axis (back-and-forth) direction by rotation of a Y-axis servomotor (10*m*), and an X-axis movement means (F) which moves in the X-axis (lateral) direction by rotation of an X-axis servomotor (20*m*); a turntable device (30) being placed on the XY slide mechanism (G), having a turntable (31) on an upper side, and causing the turntable (31) to be rotated by rotation of a C2-axis servomotor (30*m*); a central shaft (42*a*) fixed to the turntable (31); the support roller (42) supported by an upper end portion of the central shaft (42*a*); a cylindrical shaft (47) placed on the turntable (31) and rotatably supported by the central shaft (42*a*); the bending roller (43) arranged on an upper end face of the cylindrical shaft (47); and a bending device (40) causing the cylindrical shaft (47) to be rotated around the central shaft (42*a*) by rotation of a C1-axis servomotor (40*m*). In the above construction, the pipe is bent by causing, by the XY slide mechanism (G), movement of the center (O) of the support roller (42) by a first predetermined angle along a semicircular arc having a diameter equal to the difference (Dn−D1) between each of the bend diameters (Dn) of the pipe W and the diameter (D1) of the support roller (42), rotating the support roller (42) by the first predetermined angle, turning the bending roller (43) by the first predetermined angle around the support roller (42), and further turning the bending roller (43) by a second predetermined angle around the support roller (42) by rotating the cylindrical shaft (47) by rotation of the C1-axis servomotor (40*m*), the rotating of the support roller (42) by the first predetermined angle and the turning of the bending roller (43) by the first predetermined angle are realized by rotating the turntable (31) by rotation of the C2-axis servomotor (30*m*) in synchronization with the movement of the center (O), and the turning of the bending roller (43) by the second predetermined angle is realized by rotating the cylindrical shaft (47) by rotation of the C1-axis servomotor (40*m*).

The bending method described in claim 2 uses the pipe bending machine (100) described in claim 1, and successively performs the bending operations with the bend diameters (D2, D3, . . . , Dn) greater than the diameter (D1) of the support roller (42) by use of the support roller (42). The bending method described in claim 2 includes: a step of causing, in response to a command to move (along an X-axis and a Y-axis) the XY slide mechanism (G), the movement of the center (O) of the support roller (42) by the first predetermined angle along the semicircular arc having the diameter equal to the difference (Dn−D1) between each of the bend diameters (Dn) of the pipe W and the diameter (D1) of the support roller (42); a step of rotating the support roller (42) by the first predetermined angle and turning the bending roller (43) by the first predetermined angle around the support roller (42), by rotating, in response to a command to rotate the C2-axis servomotor (30*m*), the turntable (31) in synchronization with the movement of the center (O); and a step of turning the bending roller (43) by a second predetermined angle around the support roller (42) by rotating the cylindrical shaft (47) in response to a command to rotate the C1-axis servomotor (40*m*).

DESCRIPTION OF EMBODIMENTS

A pipe bending machine according to the present invention and a bending method for producing a spiral pipe by using the pipe bending machine are explained in detail below with reference to the drawings.

As for the coordinate system and the motion nomenclature for the NC machine, Industrial automation system in JIS B6310 (ISO/DIS 841: 1994 Industrial automations-Physical device control-Coordinate system and motion nomenclature) provides stipulations.

According to the stipulations in the above standard, when the cylindrical shaft of the support roller on the turntable corresponds to the Z-axis, the lateral axis perpendicular to the Z-axis is the X-axis, the longitudinal axis perpendicular to the Z-axis is the Y-axis, the turn in the bending device is made around the C1-axis, and the turn in the turntable device is made around the C2-axis.

Figure 1:
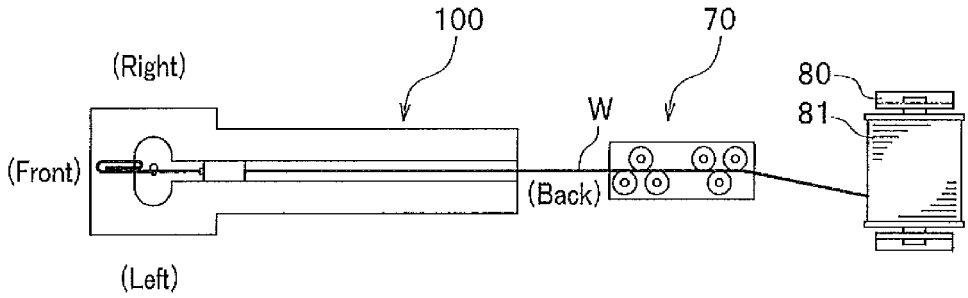
FIG. 1 is a diagram illustrating a configuration of the entire system including a pipe bending machine according to the present invention.

As illustrated in FIG. 1, a coil 81, a straightener 70, and a pipe bending machine 100 are arranged in this order from the right to the left. The coil 81 is a metal pipe attached to a coil stand 80. The straightener 70 straightens the pipe. The pipe bending machine 100 successively bends the pipe for realizing the bend diameters of a spiral pipe.

Figure 2:
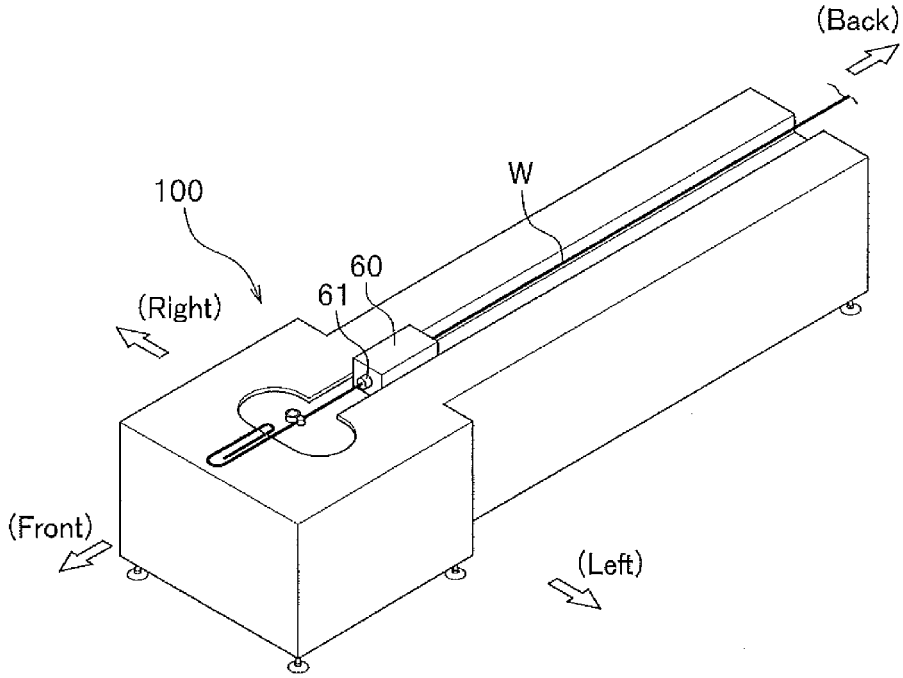
FIG. 2 is a magnified perspective view of the pipe bending machine according to the present invention.

As illustrated in FIG. 2, the pipe bending machine 100 according to the present invention has a total length of 4 m, a width of 1.2 m, and a height of 0.9 m. The main body of the pipe bending machine 100 according to the present invention is arranged inside the tip end portion. Therefore, the following explanations are focused on the mechanism of the main body of the pipe bending machine 100 according to the present invention.

A pipe W, for example, a copper pipe, which is straightened by the straightener 70, is inserted into collet chuck 61 in a chuck device 60, and is then fed to the pipe bending machine 100.

The collet chuck 61 or a three jaw chuck is attached to a tip end portion of the chuck device 60, and the chuck is brought into a clamped state or an unclamped state by a push or a pull realized by an air cylinder (not shown). Arrangements for linear motion guides (not shown) are provided at the bottom end portion of the chuck device 60 so that the chuck device 60 can be moved (forward and backward) over the full movable length by a driving system using a servomotor and a ball screw. However, the chuck device 60 may be moved in other driving techniques. The chuck device 60 feeds the pipe W when the chuck is in the clamped state and the chuck device 60 moves forward. The chuck device 60 moves backward when the chuck is in the unclamped state.

<Construction of Pipe Bending Machine>

Figure 3:
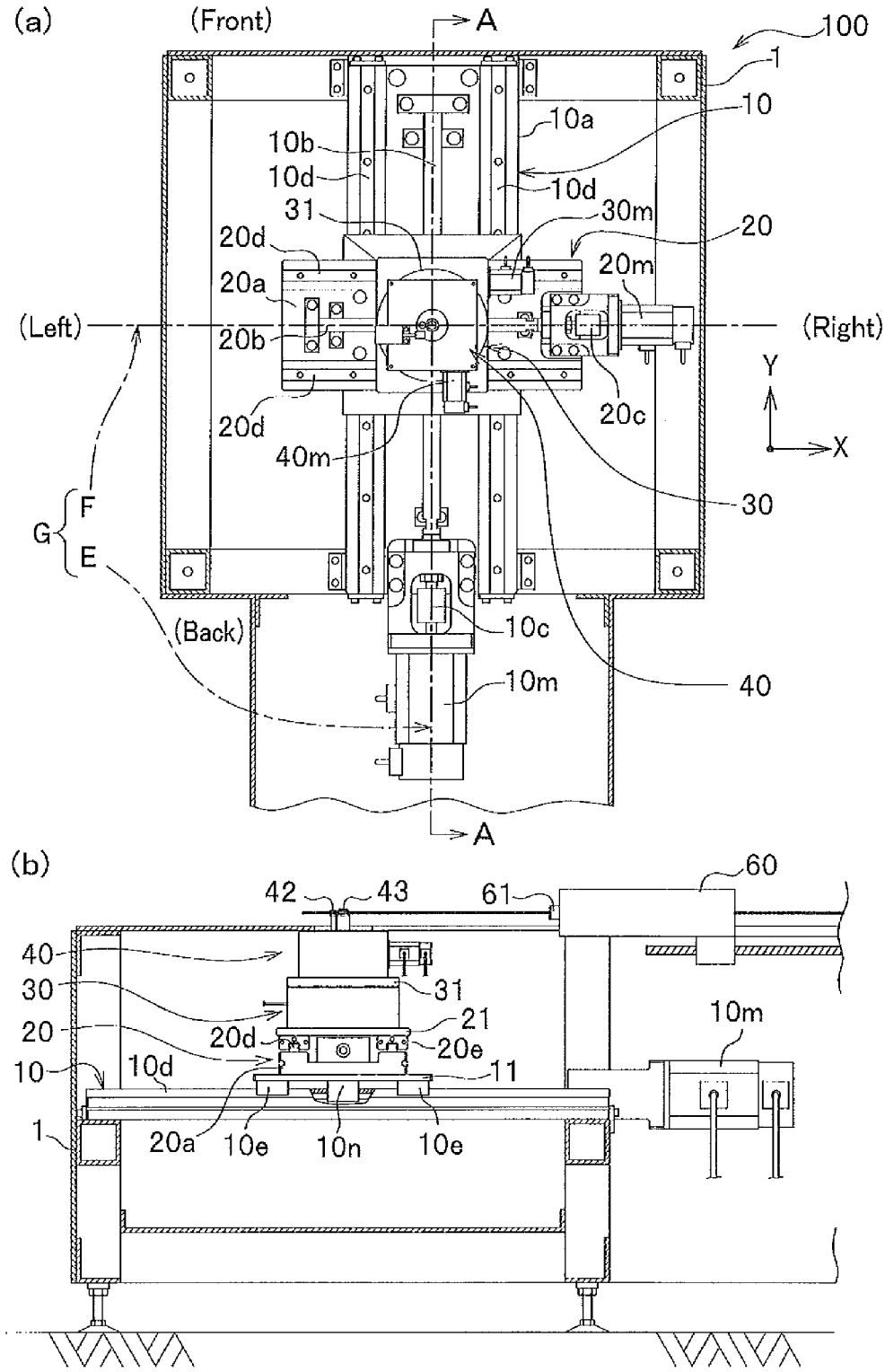
FIG. 3 illustrates the pipe bending machine according to the present invention, where the part (a) is a plan view of the pipe bending machine with an upper cover removed, and the part (b) is a cross-sectional view at a cross section indicated by the A-A line in the part (a).
Figure 4:
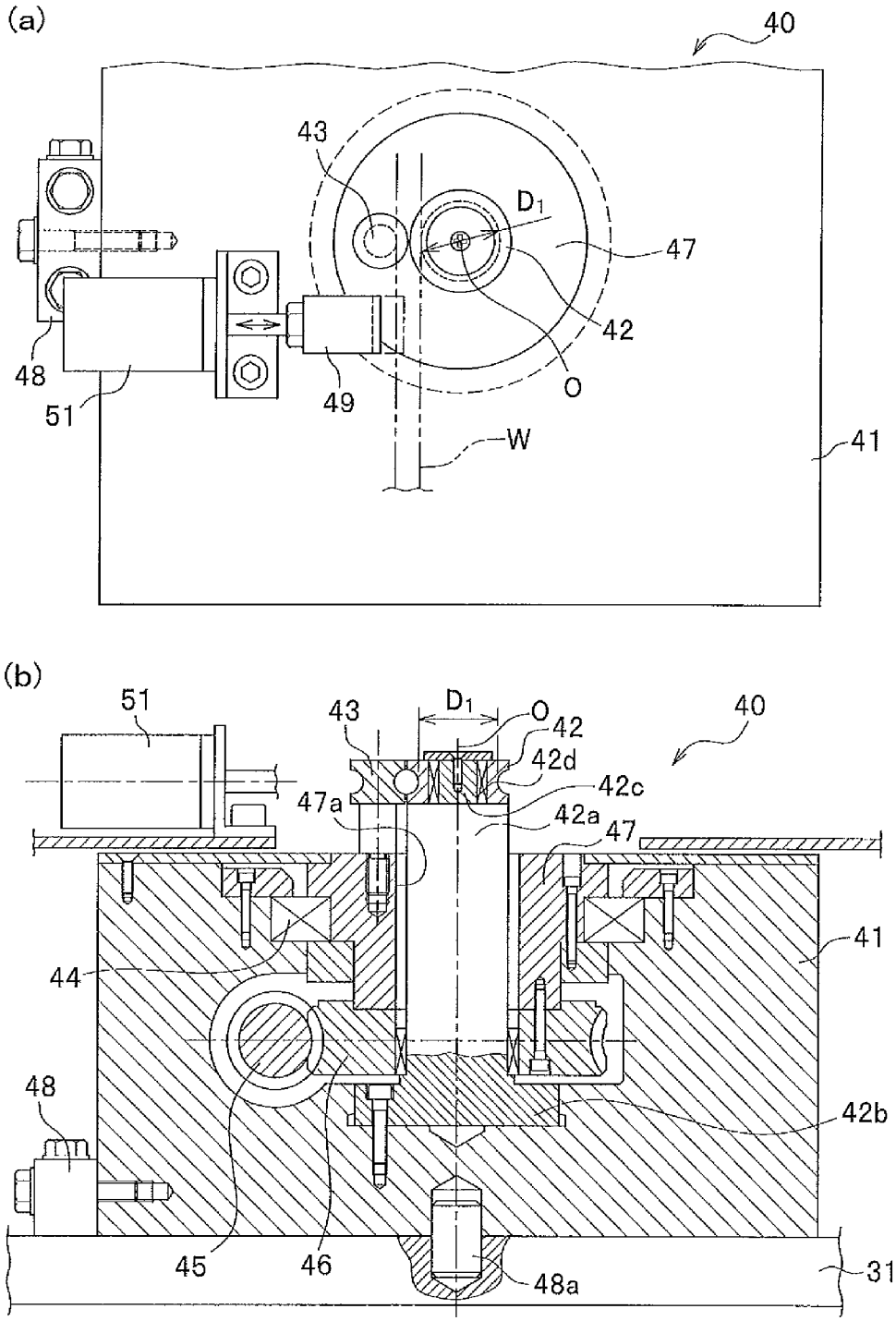
FIG. 4 illustrates the bending machine, where the part (a) is a plan view, and the part (b) is a cross-sectional view.

As illustrated in FIG. 3, (*a*) and (*b*), the pipe bending machine 100 is constituted by a base frame 1, an XY slide mechanism G, a turntable device 30, and a bending device 40. The XY slide mechanism G includes a Y-axis movement means E, an X-axis movement means F. The Y-axis movement means E moves along the Y-axis (forward and backward) and the X-axis movement means F moves along the X-axis (leftward and rightward). The turntable device 30 is placed on the XY slide mechanism G, has a turntable 31 on the upper side, and rotates the turntable 31. The bending device 40 is placed on the turntable 31. In the bending device 40, a cylindrical shaft 47, oriented in the vertical direction, (illustrated in FIG. 4 (*b*)) is rotatably supported. As illustrated in FIG. 4 (*b*), a support roller 42 for pipe bending is arranged at the center of the bending device 40. In addition, a bending roller 43 is arranged in such a manner that the bending roller 43 can turn around the center O of the support roller 42.

<Constitution of Base Frame>

As illustrated in FIG. 3, (*a*) and (*b*), the base frame 1 has a framed structure which is mainly formed of square pipes. The members of the framed structure are joined by welding, so that the framed structure of the base frame 1 has high rigidity. However, the base frame 1 needs not be limited to the square-pipe structure, and may use other materials. For example, the base frame 1 may use other steel materials such as H-beams, I-beams, steel channels, and steel angles, and may be realized by a casted head structure.

<Construction of the XY Slide Mechanism>

As illustrated in FIG. 3, (*a*) and (*b*), the XY slide mechanism G is constituted by the Y-axis movement means and the X-axis movement means F. The Y-axis movement means E moves along the Y-axis (forward and backward) and the X-axis movement means F moves along the X-axis (leftward and rightward).

Although, in the illustrated construction, the X-axis movement means F is arranged above the Y-axis movement means E, alternatively, the X-axis movement means F may be arranged under the Y-axis movement means E. In the following explanations, the Y-axis movement means E and the X-axis movement means F are respectively referred to as the Y-axis slide device 10 and the X-axis slide device 20. That is, the XY slide mechanism G is the set of the Y-axis slide device 10 and the X-axis slide device 20.

<Construction of Y-axis Slide Device>

The Y-axis slide device 10 is a slide device for Y-axis control which moves a Y-axis slide 11 forward or backward. The Y-axis slide 11 has a planar shape and is placed on upper surfaces of linear motion nuts 10*e*.

The Y-axis slide device 10 is placed in the back-and-forth direction on the frame 1 and fixed to the frame 1.

As illustrated in FIG. 3, (*a*) and (*b*), in the Y-axis slide device 10, a base 10*a*, a Y-axis ball screw 10*b*, a nut 10*n*, and a Y-axis servomotor 10*m* constitute the Y-axis movement means E. The base 10*a* has a rectangular shape in a plan view, the Y-axis ball screw 10*b* is arranged at the center of the base 10*a*, the nut 10*n* is screwed into the Y-axis ball screw 10*b*, and a shaft end of the Y-axis ball screw 10*b* is coupled to the Y-axis servomotor 10*m* through a coupling 10*c*.

In addition, linear motion guides 10*d* are arranged on the left and right sides of the Y-axis slide device 10 for guiding in the Y-axis direction, and two linear motion nuts 10*e* are engaged with each of the linear motion guides 10*d*.

The planar Y-axis slide 11 is placed on the upper surfaces of the four linear motion nuts 10*e*. The nut 10*n* is connected to the lower surface of the Y-axis slide 11, and converts the rotation of the Y-axis servomotor 10*m* into a linear motion, so that the Y-axis slide 11 is moved in the Y-axis direction.

<Construction of X-axis Slide Device>

The X-axis slide device 20 is a slide device for X-axis control which moves an X-axis slide 21 leftward or rightward. The X-axis slide 21 has a planar shape and is placed on upper surfaces of linear motion nuts 20*e*.

As illustrated in FIG. 3, (*a*) and (*b*), the X-axis slide device 20 is placed on the Y-axis slide 11 in the Y-axis slide device 10.

In the X-axis slide device 20, a base 20*a*, an X-axis ball screw 20*b*, a nut 20*n*, and an X-axis servomotor 20*m* constitute the X-axis movement means F. The base 20*a* has a rectangular shape in a plan view, the X-axis ball screw 20*b* is arranged at the center of the base 20*a*, the nut 20*n* is screwed into the X-axis ball screw 20*b*, and a shaft end of the X-axis ball screw 20*b* is coupled to the X-axis servomotor 20*m* through a coupling 20*c*.

In addition, linear motion guides 20*d* are arranged on the front and rear sides of the X-axis slide device 20 for guiding in the X-axis direction, and two linear motion nuts 20*e* are engaged with each of the linear motion guides 20*d*. The planar X-axis slide 21 is placed on the upper surfaces of the four linear motion nuts 20*e*. The nut 20*n* is connected to the lower surface of the X-axis slide 21, and converts the rotation of the X-axis servomotor 20*m* into a linear motion, so that the X-axis slide 21 is moved in the X-axis direction.

<Construction of Turntable Device>

The turntable device 30 is a turntable for C2-axis control, placed on the X-axis slide 21 in the X-axis slide device 20, and rotates a turntable 31 (not shown).

As illustrated in FIG. 4 (*b*), a gear-reduction device, which is a combination of a worm and a worm wheel, is built in the turntable device 30. The arrangement of the gear-reduction device in the turntable device 30 is similar to the arrangement of a gear-reduction device in the bending device 40, which is explained later.

The rotation of the servomotor 30*m* is converted by the worm wheel into rotation of the cylindrical shaft (which stands upright), so that the turntable 31 (fixed to the upper end of the cylindrical shaft) is turned. Alternatively, the rotary driving may be realized by using a combination of large and small spur gears or a pulley, instead of the worm gear.

<Construction of Bending Device>

As illustrated in FIG. 4 (*b*), the bending device 40 is placed, concentrically with the turntable 31, on the turntable 31 of the turntable device 30 by using a positioning pin 48*a*, and fixed to the turntable 31 by using a position locator 48.

The bending device 40 is arranged in the uppermost position, and turns the bending roller 43 around the center O of the support roller 42 (having the diameter D1) under C1-axis control.

The gear-reduction device, in which the worm 45 and the worm gear 46 are engaged, is built in the bending device 40. The upright cylindrical shaft 47, which is fixed to the worm wheel 46, is rotatably supported by a bearing 44. The use of the above worm gear enables thinning.

In addition, a central shaft 42*a* is inserted through a through-bore 47*a* in the cylindrical shaft 47, and a flange portion 42*b* in the lower part of the central shaft 42*a* is engaged with a depression arranged in the bottom of the body 41. In addition, the support roller 42 is attached via needle rollers 42*d* to a diameter-reduced, upper portion of the central shaft 42*a* (as a diameter-reduced shaft 42*c*), so that the support roller 42 is rotatably supported. A groove having the shape of a semicircle is formed on the outer circumferential surface of the support roller 42 in such a manner that the pipe W can be inserted through and engaged with the groove.

The bending roller 43 is fixed to the cylindrical shaft 47 by being screwed into a threaded hole formed at the upper end surface of the cylindrical shaft 47. The upper part of the bending roller 43 is also rotatable as the support roller 42.

A groove having the shape of a semicircle is also formed on the outer circumferential surface of the bending roller 43 in such a manner that the pipe W can be inserted through and engaged with the groove.

A preferable diameter D1 of the support roller 42 is, for example, 20 mm, and a preferable diameter of the bending roller 43 is, for example, 14 mm.

The rotation of the cylindrical shaft 47 and the resultant turning of the bending roller 43 are caused by rotation of the servomotor 40*m* (cf. FIG. 3 (*a*)). In response to an NC command for the C1-axis, the bending roller 43 can be turned by an arbitrary angle.

In addition, the pipe retainer 49 illustrated in FIG. 4, (*a*) and (*b*) is provided for suppressing deflection of the pipe W. In this example, the pipe retainer 49 is put in and out by a pneumatic actuator 51.

A bending method for producing a spiral pipe W with the bend diameters Dn is explained below.

The first one of the bend diameters Dn is the bend diameter D1, and the second one of the bend diameters Dn is the bend diameter D2. Therefore, the bending with the bend diameter D2 is explained in detail.

Hereinbelow, the procedure and the principle of a bending method of bending with the bend diameter D2 (which is greater than the diameter of the support roller 42) by using the support roller 42 having the small diameter D1 is explained with reference to FIG. 5 ((*a*) to (*d*)) and FIG. 6 (the magnified diagram).

Figure 5:
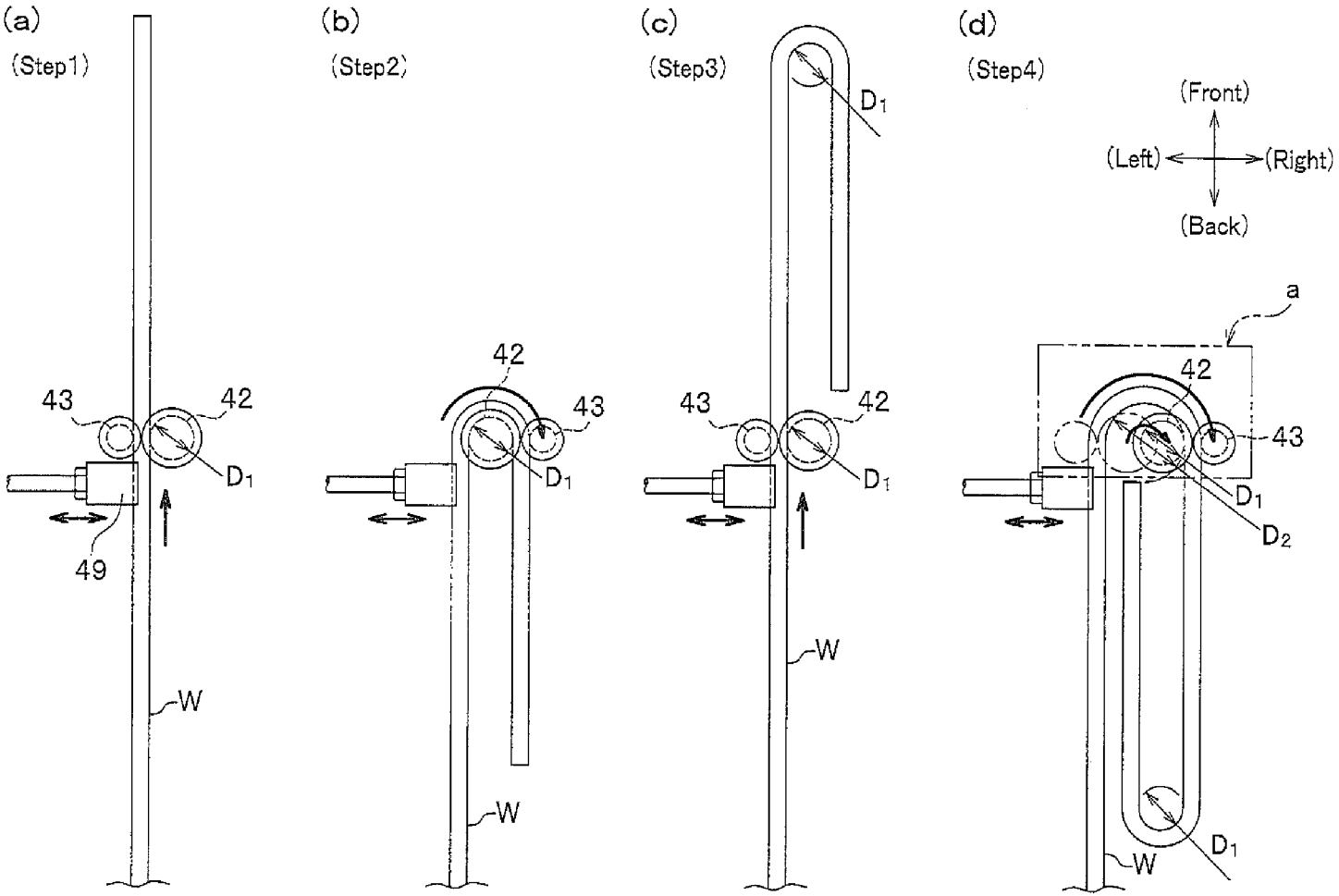
FIG. 5 illustrates a bending method for producing a spiral pipe with a large bend diameter, where the parts (a) to (d) illustrate the first to fourth steps.

As illustrated in FIG. 5 (*a*), in the first step, the pipe W is fed forward by moving the chuck device 60 forward, although the chuck device 60 is not shown in FIG. 5.

As illustrated in FIG. 5 (*b*), in the second step, the bending roller 43 is turned around the support roller 42 (having the diameter D1) by 180 degrees by the rotary driving (around the C1-axis) in the bending device 40, so that the pipe W is bent to have the bend diameter D1.

As illustrated in FIG. 5 (*c*), in the third step, the pipe W is fed forward by moving the chuck device 60 forward.

As illustrated in FIG. 5 (*d*), in the fourth step, the center O of the support roller 42 moves along the X- and Y-axis directions in cooperation with the bending roller 43 so that the diameter of the support roller 42 is virtually increased to the bend diameter D2 and the pipe W is bent to have an inner curvature corresponding to the target bend diameter D2 of the spiral pipe.

The above operations are performed at successive positions of the pipe W from a position near the center of the spiral to a position near the end of the spiral.

Figure 6:
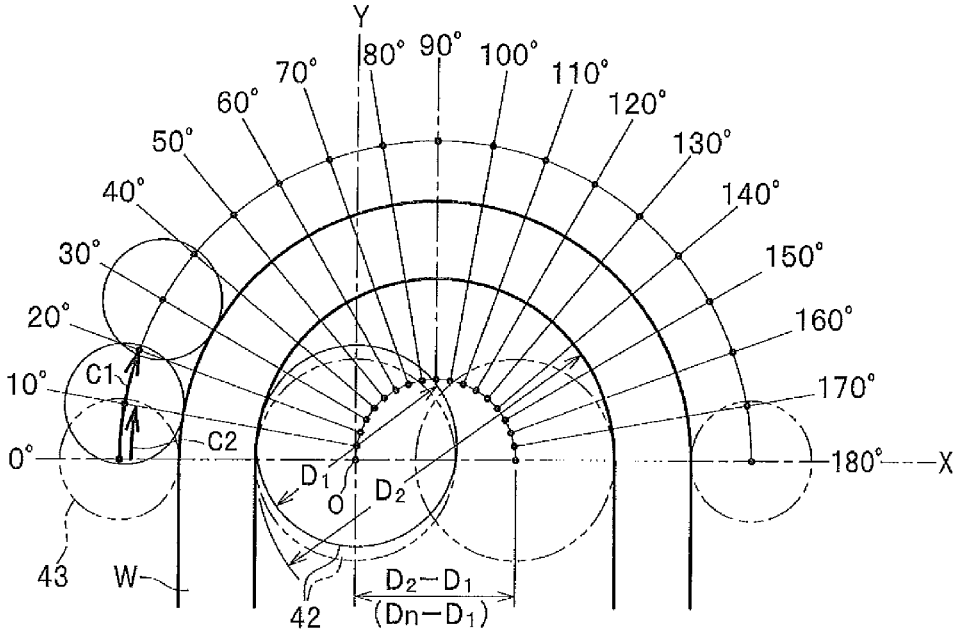
FIG. 6 is a diagram illustrating the principle of the bending by the pipe bending machine according to the present invention.
Figure 7:
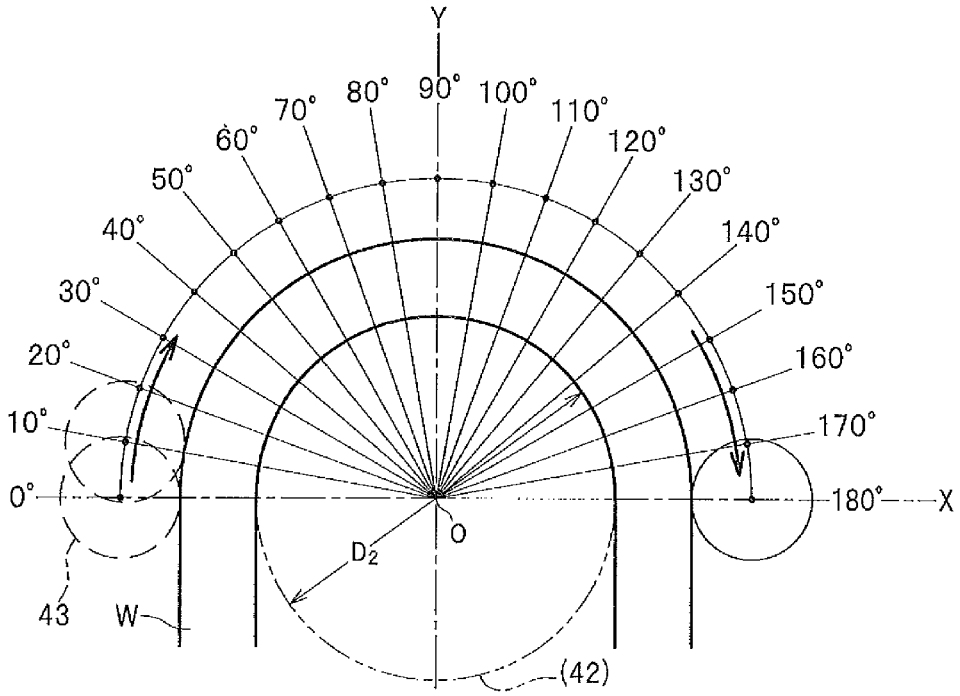
FIG. 7 is a diagram illustrating a method of bending with a large bend diameter according to a conventional technique.

FIG. 6 is a magnified developed view of the portion "a" illustrated in FIG. 5 (*d*), and FIG. 7 is a diagram illustrating a conventional bending method.

As illustrated in FIG. 7, according to the conventional bending method, the support roller 42 with the diameter D1 is replaced with the support roller 42 having the larger bend diameter D2, and thereafter the bending roller 43 is turned by 180 degrees in a similar manner to the second step. However, according to the conventional bending method, the number of different types of support rollers increases, and work for the replacement is needed. Therefore, it is difficult for the conventional bending method to successively bend a pipe for producing a spiral pipe W.

On the other hand, according to the present invention, the bending for producing a spiral pipe W with large bend diameters Dn is performed by using only the single support roller 42 having the small diameter D1 as illustrated in FIG. 6.

According to the principle of the present invention, in order to virtually increase the diameter of the support roller 42 (having the diameter D1) to the diameter Dn, the Y-axis slide device 10 being freely movable along the Y-axis and the X-axis slide device 20 being freely movable along the X-axis are arranged, and the center O of the support roller 42 is moved by a predetermined amount along a 180-degree arc which has a diameter corresponding to the diameter difference Dn−D1 and is convex upward in the first quadrant of the XY coordinate system.

For example, assume that the diameter D1 of the support roller 42 is 20 mm, and the first one D2 of the bend diameters Dn of the spiral pipe W is 36 mm.

In this case, the diameter difference D2−D1 is 36 mm−20 mm=16 mm, and the Y-axis slide device 10 and the X-axis slide device 20 are moved so that the center O of the support roller 42 is moved along the 180-degree arc which has a diameter corresponding to the above diameter difference and is convex upward. Therefore, the support roller 42 can be moved so that the outer circumference of the support roller 42 draws a contour with the bend diameter Dn. That is, the diameter of the support roller 42 can be virtually increased to the bend diameter Dn.

Table 1 indicates the amounts of movement (along the X-axis and the Y-axis) in the above movement along the 180-degree arc. In the column "Division", predetermined angles in increments of 10 degrees are indicated. Although the angle is divided in increments of 10 degrees for the bending with the bend diameter D2 in this example, the increments may be reduced to, for example, 5 degrees, 4 degrees, 3 degrees, . . . for the bending with greater bend diameters Dn. Further, the movement may be divided on the basis of the length along the arc instead of the angle.

The amounts of movement indicated in Table 1 are values for the case where D1 is 20 mm and D2 is 36 mm.

In the column "C2-axis", the turning angles in the turning of the entire bending device 40 are indicated.

In the column "C1-axis", the turning angles by which the turning of the bending roller 43 is advanced relative to the turning around the C2-axis are indicated.

TABLE 1

| Division | X-axis (mm) | Y-axis (mm) | C2-axis (deg) | C1-axis (deg) |
|---|---|---|---|---|
| 0° | 0.00 | 0.00 | 0° | 10° |
| 10° | 0.13 | 1.39 | 10° | 10° |
| 20° | 0.48 | 2.74 | 20° | 10° |
| 30° | 1.07 | 4.00 | 30° | 10° |
| 40° | 1.87 | 5.14 | 40° | 10° |
| 50° | 2.86 | 6.13 | 50° | 10° |
| 60° | 4.00 | 6.93 | 60° | 10° |
| 70° | 5.26 | 7.52 | 70° | 10° |
| 80° | 6.61 | 7.87 | 80° | 10° |
| 90° | 8.00 | 8.00 | 90° | 10° |
| 100° | 9.39 | 7.87 | 100° | 10° |
| 110° | 10.74 | 7.52 | 110° | 10° |
| 120° | 12.00 | 6.93 | 120° | 10° |
| 130° | 13.14 | 6.13 | 130° | 10° |
| 140° | 14.13 | 5.14 | 140° | 10° |
| 150° | 14.93 | 4.00 | 150° | 10° |
| 160° | 15.52 | 2.74 | 160° | 10° |
| 170° | 15.88 | 1.39 | 170° | 10° |
| 180° | 16.00 | 0.00 | 180° | 10° |

That is, according to the turning angles indicated in the column "C2-axis" in Table 1, the turntable device 30 smoothly turns under C2-axis control in synchronization with the movement along the X-axis and Y-axis corresponding to the 10-degree increments of the predetermined angle (cf. FIG. 6).

Further, according to the turning angles indicated in the column "C1-axis" in Table 1, the bending device 40 advances the turning of the bending roller 43 by 10 degrees, relative to the turning around the C2-axis, under the C1-axis control in synchronization with the turning in the turntable device 30. Then, operation for bending the pipe W to the predetermined bend diameter D2 is performed by repeating a turn and a return while maintaining the difference of 10 degrees between the turning angles.

In other words, the operations for bending the pipe W to the predetermined bend diameter D2 are performed by the turn of the bending roller 43 by 10 degrees, which is the difference between the turning angle of the bending roller 43 caused by (the C2-axis control in) the turntable device 30 (e.g., 10 degrees) and the turning angle of the bending roller 43 caused by the bending device 40 (e.g., 20 degrees)

However, the turning angle by which the bending roller 43 is turned is not limited to 10 degrees, may be varied according to the bend diameter Dn, and is preferably 2 to 20 degrees.

Alternatively, the arc length by which the bending roller 43 is turned is preferably 5 to 20 mm. The arc length by which the bending roller 43 is turned may be changed according to the bend diameter Dn as needed.

Figure 8:
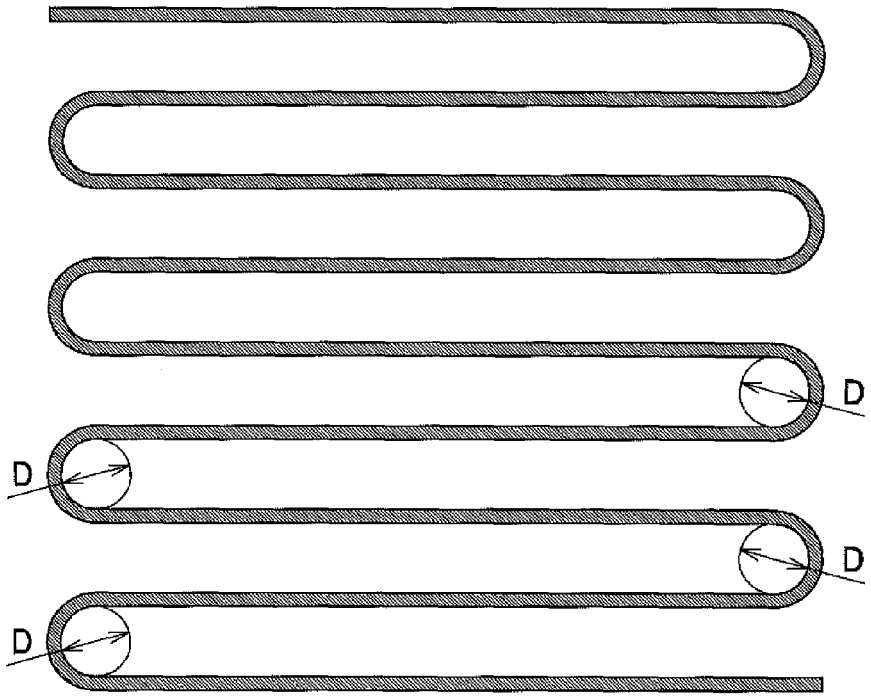
Prior Art FIG.8
FIG. 8(*a*) is a plan view illustrating the shape of a conventional meandering type heat exchanger pipe, and FIG. 8(*b*) is a plan view illustrating the shape of a spiral heat exchanger pipe.
Figure 8:
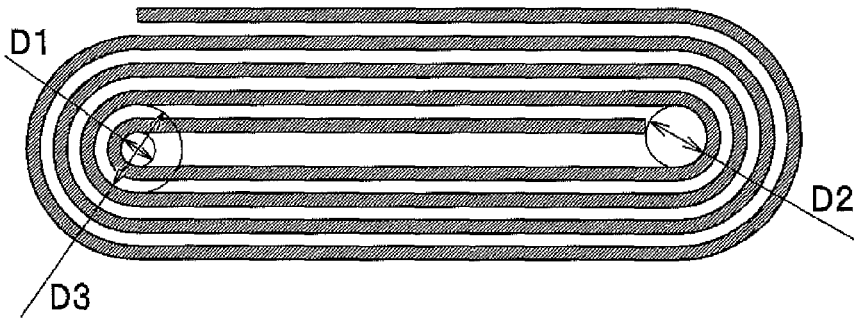
Prior Art FIG.8

Thereafter, the pipe W is further fed forward by forward movement of the chuck device 60 (not shown) in a similar manner to the third step. As illustrated in FIG. 8 (*b*), the bending with the bend diameter D3 is to be performed subsequent to the bending with the bend diameter D2. The bending with the bend diameter D3 is performed in a similar manner to the fourth step.

In the bending with each of the larger bend diameters D3, D4, D5, . . . , Dn, the operations in the third and fourth steps are performed. Therefore, it is possible to easily perform, in succession, the bending with each of the larger bend diameters D3, D4, D5, . . . , Dn for the spiral pipe W.

Since the explanations on the bending with the bend diameter D3 are similar to the explanations on the bending with the bend diameter D2, the explanations on the bending with the bend diameter D3 are not presented here.

In the above explanations on the present embodiment, the coil 81 of the continuous metal pipe attached to the coil stand 80 is indicated as an example. Alternatively, a straight pipe which is cut to have a predetermined length may be directly subjected to the bending by the pipe bending machine 100.

The diameter of the support roller 42 is virtually increased to the bend diameters (D2, D3, . . . , Dn), which are greater than the actual diameter of the support roller 42, by using the XY slide mechanism G (which changes the position of the center O of the support roller 42). Therefore, the diameter to be increased can be arbitrary set even when the bend diameter is increased as D2, D3, . . . , Dn. Thus, the bending can be performed in succession.

The bending with the large bend diameters (Dn) is performed by using the support roller 42 and the turning angle of the bending device 40 caused by the turntable device 30.

Further, in order to improve the precision in the bend diameter (Dn) for finishing, the bending is performed by use of the difference in the turning angle of the bending roller 43 arranged in the bending device 40.

Figure 9:
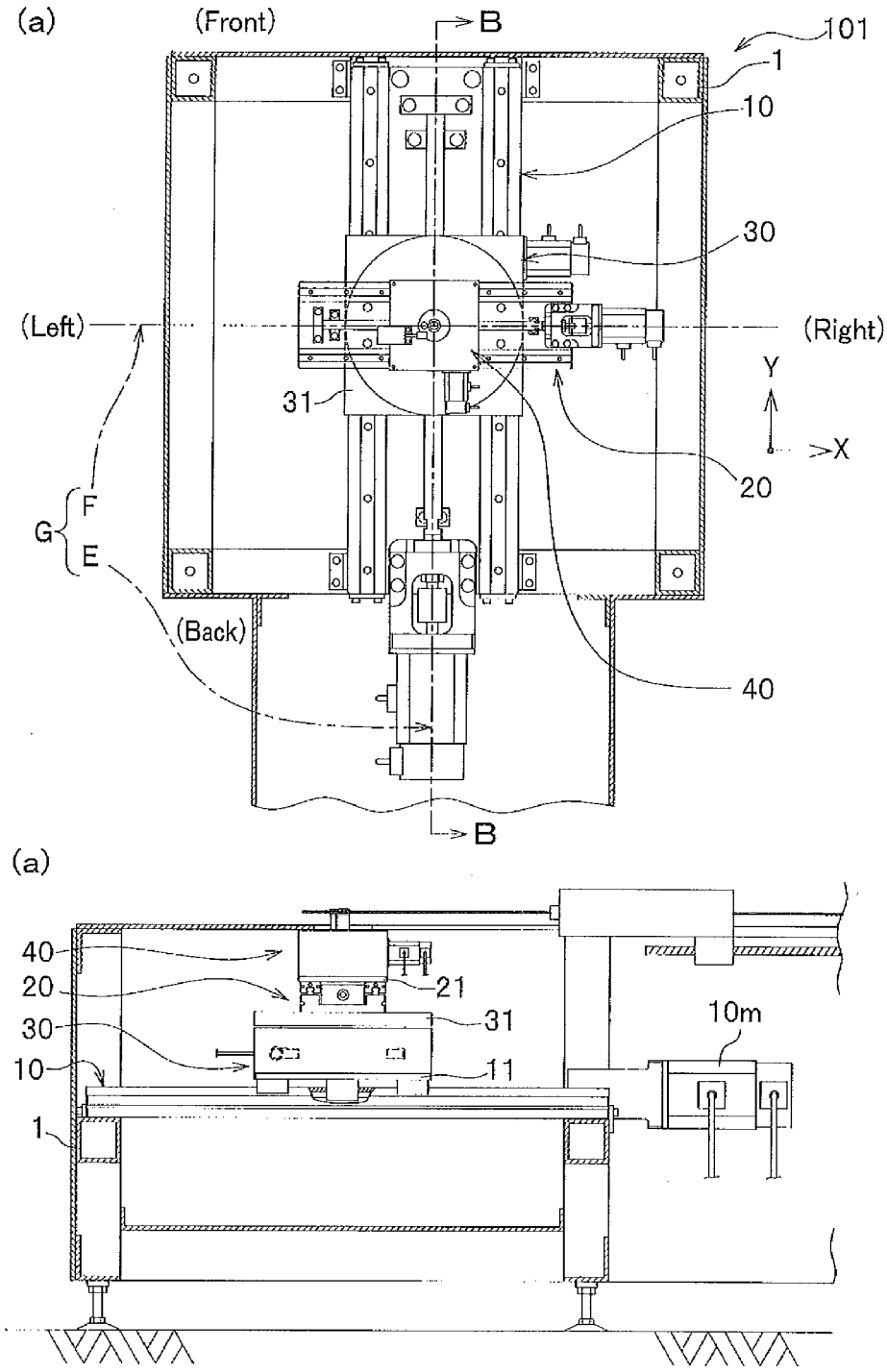
FIG. 9 illustrates a pipe bending machine as a variation of the present invention, where the part (a) is a plan view with an upper cover removed, and the part (b) is a cross-sectional view at a cross section indicated by the B-B line in the part (a).
Figure 10:
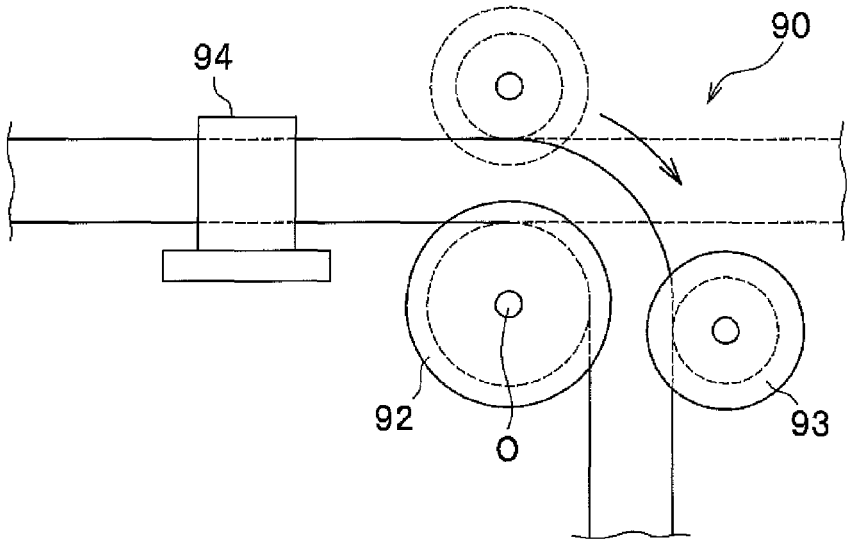
Prior Art FIG.10
FIG. 10 is a plan view a conventional pipe bending machine.

The present invention is not limited to the embodiment explained above, and may be modified as appropriate. For example, it is possible to reconfigure the pipe bending machine by changing the order of stacking of the devices as illustrated in FIG. 9. The differences of the construction of FIG. 9 from the construction of FIG. 3 are explained below.

In the construction of FIG. 3, the X-axis slide device 20 is arranged in the second layer, and the turntable device 30 is arranged in the third layer. It is possible to reconfigure the X-axis slide device 20 and the turntable device 30 in such a manner that the turntable device 30 is arranged in the second layer, and the X-axis slide device 20 is arranged in the third layer, as illustrated in FIG. 9.

In addition, it is possible to separately arrange the chuck device 60, and replace the chuck device 60 with the X-axis slide device 20, as illustrated in FIG. 2.

Further, the movement (forward and backward) of the chuck device 60 may be realized by use of, for example, a system constituted by a servomotor and a timing belt, instead of the explained driving system constituted by the servomotor and the ball screw. In this case, a timing belt is arranged instead of the ball screw in such a manner that the timing belt is engaged with a pulley attached to a motor shaft of the servomotor, and the chuck device 60 is moved forward and backward through the timing belt. Furthermore, other systems may be used instead of the above system using the belt.

The pipe W is preferably formed of a metal exhibiting high conductivity such as copper or aluminum. However, the pipe W may be other pipe materials.

INDUSTRIAL APPLICABILITY

The pipe bending machine according to the present invention includes: the XY slide mechanism having the Y-axis movement means which moves in the back-and-forth direction and the X-axis movement means which moves in the lateral direction; the turntable device which rotates the turntable on the upper side; the bending device which is placed on the turntable and rotates the cylindrical shaft; the support roller which is supported by an upper end portion of the central shaft inserted through the hole in the cylindrical shaft and the bottom surface of which is fixed to a lower end portion of the central shaft; and the bending roller arranged adjacent to the support roller on the upper end face of the cylindrical shaft, where the cylindrical shaft can freely turn around the center of the support roller.

In the bending with a bend diameter greater than the diameter of the support roller, the XY slide mechanism which changes the position of the support roller is used. Since the bending with the greater bend diameter using the support roller can be realized by the difference between the turning angle of the bending device caused by the turntable device and the turning angle of the bending roller arranged in the bending device, the bending operations for making respective bends in a spiral pipe in which the bend diameter is increased after every bend can be performed in succession, while such bending operations cannot be performed in succession by the conventional pipe bending machine.

In addition, the present invention can provide a pipe bending machine which can cope with downsizing of water heaters.

In the bending method according to the present invention (using a pipe bending machine), the pipe bending machine described in claim 1 is used. In order to enable successive execution of the bending operations with the bend diameters greater than the diameter of the support roller, the bending device is turned by the first predetermined angle (determined by division) in response to a command to rotate the turntable device in synchronization with the movement of the center of the support roller along the arc (convex upward) having the diameter equal to the difference between the two diameters, and the bending roller is turned forward and backward by the second predetermined angle or the predetermined arc length (determined by division) in response to a command to rotate the bending device, so that the pipe can be bent with each of the predetermined bend diameters by use of the difference between the turning angle of the bending roller caused by the turntable device and the turning angle of the bending roller caused by the bending device.

Therefore, it is possible to provide a bending method which can produce a spiral pipe in which the bend diameter increases after every bend, although the spiral pipe cannot be conventionally produced as above.

As illustrated in FIG. 8 (*a*), meandering types pipes have been used as the conventional heat exchanger pipes. However, the meandering type pipes need large installation space. Further, the future direction of the products such as water heaters or EcoCute is weight reduction and downsizing. In order to achieve downsizing, heat exchanger pipes are spiral types as illustrated in FIG. 8 (*b*), which can be installed in narrow space. The pipe bending machine according to the present invention is suitable for pipe bending for spiral heat exchanger pipes, which can be installed in narrow space.

List of the Reference Numbers

| | |
|---|---|
| 1 | Frame |
| 10: | Y-axis slide device (Y) |
| 20: | X-axis slide device (X) |
| 30: | turntable device (C2) |
| 31: | turntable |
| 40: | bending device (C1) |
| 42: | support roller |
| 42a: | central shaft |
| 43: | bending roller |
| 51: | pneumatic actuator |
| 60: | chuck device |
| 100: | pipe bending machine |
| D1: | diameter (support roller) |
| D2, D3, D4 . . . Dn: | bend diameter |
| E: | Y-axis movement means |
| F: | X-axis movement means |
| G: | XY slide mechanism |

The invention claimed is:

1. A pipe bending machine which feeds a pipe to a gap between a support roller and a bending roller, and successively performs bending operations with bend diameters greater than a diameter of the support roller while changing a position of a center of the support roller in synchronization with a turning angle of the bending roller, the pipe bending machine comprising:

an XY slide mechanism being placed on a frame and including, a Y-axis movement means which moves in a Y-axis direction by rotation of a Y-axis servomotor, and an X-axis movement means which moves in an X-axis direction by rotation of an X-axis servomotor;

a turntable device being placed on the XY slide mechanism, the turntable device having a turntable on an upper side and configured to rotate the turntable, by rotation of a C2-axis servomotor;

a central shaft fixed to the turntable;

the support roller supported by an upper end portion of the central shaft;

a cylindrical shaft placed on the turntable and rotatably supported by the central shaft;

the bending roller arranged on an upper end face of the cylindrical shaft; and a bending device configured to rotate the cylindrical shaft around the central shaft by rotation of a C1-axis servomotor;

wherein the XY slide mechanism is configured to bend the pipe by moving the center of the support roller by a first predetermined angle along a semicircular arc having a diameter equal to a difference between each of the bend diameters of the pipe and the diameter of the support roller, rotating the support roller by the first predetermined angle, turning the bending roller by the first predetermined angle around the support roller, and further turning the bending roller by a second predetermined angle around the support roller by rotating the cylindrical shaft by rotation of the C1-axis servomotor, the rotating of the support roller by the first predetermined angle and the turning of the bending roller by the first predetermined angle are realized by rotating the turntable by rotation of the C2-axis servomotor in synchronization with the movement of the center, and the turning of the bending roller by the second predetermined angle is realized by rotating the cylindrical shaft by rotation of the C1-axis servomotor.

2. A bending method which uses the pipe bending machine according to claim 1, and successively performs the bending operations with the bend diameters greater than the diameter of the support roller by use of the support roller, comprising:

in response to a command to move the XY slide mechanism, a step of moving the center of the support roller by the first predetermined angle along the semicircular arc having the diameter equal to the difference between each of the bend diameters of the pipe and the diameter of the support roller;

a step of rotating the support roller by the first predetermined angle and turning the bending roller by the first predetermined angle around the support roller, by rotating, in response to a command to rotate the C2-axis servomotor, the turntable in synchronization with the movement of the center; and a step of turning the bending roller by a second predetermined angle around the support roller by rotating the cylindrical shaft in response to a command to rotate the C1-axis servomotor.

* * * * *